US006338877B1

(12) United States Patent
Kamei et al.

(10) Patent No.: US 6,338,877 B1
(45) Date of Patent: Jan. 15, 2002

(54) METHOD FOR RAPIDLY IMPARTING HYDROPHOBICITY TO A HYDROPHILICITY-IMPARTED OXIDE SOLID SURFACE

(75) Inventors: Masayuki Kamei; Takefumi Mitsuhashi, both of Ibaraki (JP)

(73) Assignee: National Institute for Research in Inorganic Materials, Tsukuba (JP)

( * ) Notice: Subject to any disclaimer, the term of this patent is extended or adjusted under 35 U.S.C. 154(b) by 0 days.

(21) Appl. No.: 09/520,616

(22) Filed: Mar. 7, 2000

(30) Foreign Application Priority Data

Dec. 2, 1999 (JP) ..... 11-343788

(51) Int. Cl.[7] ..... B05D 3/12

(52) U.S. Cl. ..... 427/444; 427/355; 427/359; 427/360

(58) Field of Search ..... 427/292, 327, 427/444, 355, 359, 360, 365

(56) References Cited

U.S. PATENT DOCUMENTS

| | | | | | |
|---|---|---|---|---|---|
| 4,099,989 | A | * | 7/1978 | Dorsey, Jr. | 148/6.27 |
| 4,966,743 | A | * | 10/1990 | Engel | 264/298 |
| 4,981,882 | A | * | 1/1991 | Smith et al. | 523/205 |
| 5,076,898 | A | * | 12/1991 | Nidola et al. | 204/128 |
| 5,225,274 | A | * | 7/1993 | Ogawa et al. | 428/333 |
| 5,510,481 | A | * | 4/1996 | Bednarski et al. | 536/120 |
| 5,908,671 | A | * | 6/1999 | Tanaka et al. | 427/535 |
| 6,048,654 | A | * | 4/2000 | Nakayama et al. | 430/19 |

* cited by examiner

*Primary Examiner*—Shrive P. Beck
*Assistant Examiner*—Wesley Markham
(74) *Attorney, Agent, or Firm*—Oblon, Spivak, McClelland, Maier & Neustadt, P.C.

(57) ABSTRACT

A method for rapidly imparting hydrophobicity to an oxide solid surface, which comprises exerting a mechanical stimulation to a desired region of a hydrophilicity-imparted oxide solid surface, to change said region to be hydrophobic.

4 Claims, 1 Drawing Sheet

METHOD FOR RAPIDLY IMPARTING HYDROPHOBICITY TO A HYDROPHILICITY-IMPARTED OXIDE SOLID SURFACE

BACKGROUND OF THE INVENTION

1. Field of the Invention

The present invention relates to a treating method for imparting hydrophilicity or hydrophobicity to a solid surface, which is useful for forming images in a printing technique, for forming fine patterns in the field of electronic ceramics or for antifogging or antifouling technique for the surfaces of various articles. Particularly, it relates to the method for rapidly imparting hydrophobicity to the entire region or an optional local region of a hydrophilicity-imparted oxide solid surface.

2. Discussion of Background

It is known that when ultraviolet rays are irradiated to a solid surface such as a titanium oxide layer coated on the surface of various articles, the titanium oxide layer surface which has been hydrophobic, will be changed to be hydrophilic, and the contact angle of water to the surface will be not more than about 5°. By utilizing this phenomenon, a coating film composed essentially of titanium oxide may be formed on the surface of various articles to make the surface hydrophilic for the purpose of antifogging or antifouling. On the other hand, in an image-forming system in e.g. printing, a method of locally modifying a hydrophilic surface to be hydrophobic, to form a hydrophilic/hydrophobic image, has been known (JP-B-5-30273, JP-A-11-58831, etc.), or in the field of electronic ceramics, a method of employing partial hydrophobic treatment at the time of forming laminated patterns, has been known (JP-A-5-97407).

Heretofore, it used to take a few weeks by means of a dark storage process to return the surface having hydrophilicity once imparted by e.g. ultraviolet ray irradiation to a surface having the initial hydrophobic property. Further, such a dark storage process is a method of waiting until the sample surface will spontaneously regain the hydrophobicity, and it has been impossible to thereby change only an optional region of the sample surface to be hydrophobic, while maintaining other regions to be hydrophilic.

SUMMARY OF THE INVENTION

It is an object of the present invention to develop a technique whereby the time required to change the surface of inorganic material from hydrophilic to hydrophobic, can be shortened from a conventional few weeks to a level of a few tens of seconds, and an optional local position of the surface of the material can be selectively so changed. Such a technique is expected to be applied to e.g. a printing technique and an antifogging or antifouling technique.

The present inventors have found it possible to rapidly impart hydrophobicity to an optional region of a hydrophilicity-imparted oxide solid surface by locally exerting a mechanical stimulation to the optional region which is desired to be changed to be hydrophobic. The present invention has been accomplished on the bases of this discovery.

That is, the present invention provides a method for rapidly imparting hydrophobicity to an oxide solid surface, which comprises exerting a mechanical stimulation to a desired region of a hydrophilicity-imparted oxide solid surface, to change said region to be hydrophobic.

Further, the present invention provides such a method for rapidly imparting hydrophobicity to an oxide solid surface, wherein the mechanical stimulation is exerted while moisture is supplemented to the desired region of the oxide solid surface.

Still further, the present invention provides such a method for rapidly imparting hydrophobicity to an oxide solid surface, wherein the oxide is an oxide containing a titanium atom.

Furthermore, the present invention provides such a method for rapidly imparting hydrophobicity to an oxide solid surface, wherein the oxide containing a titanium atom is titanium dioxide having a crystal structure of anatase type or a rutile type, or a mixture of anatase and rutile types.

DETAILED DESCRIPTION OF THE PREFERRED EMBODIMENTS

Figure 1:
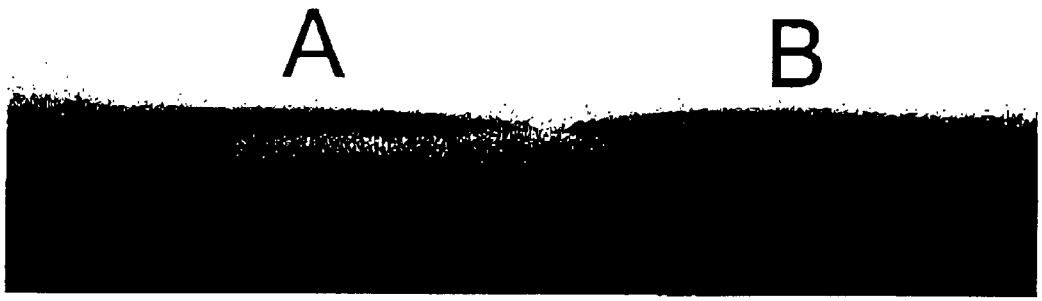
FIG. 1 is a photograph showing deposition of water droplets on the surface of the titanium oxide crystal having a crystal structure of anatase type having hydrophilic treatment applied thereto, as photographed from the direction of a side surface of the substrate by a contact angle measuring apparatus.

An oxide such as titanium oxide, strontium titanite, zinc oxide, cadmium sulfide or silicon oxide, exhibits a hydrophobic property with a contact angle of water of at least 50° on its clean surface immediately after preparation, on its surface stored in a dark room or on its surface having hydrophobic treatment applied by the method of the present invention. However, by irradiating ultraviolet rays, etc., to this hydrophobic surface thereby to introduce oxygen deficiency, the surface can be changed to be hydrophilic with a contact angle of water of at most 5°. Accordingly, such an oxide is utilized for formation of a hydrophilic coating film.

In the present invention, as a method for exerting a mechanical stimulation, the surface may be pressed by a pressing means or may be rubbed with a wiper or a cloth. The degree of the pressing force or the frictional force may be determined experimentally depending upon the degree of the hydrophilicity of the oxide surface or the degree of the desired hydrophobicity. For example, when a simple means such as a metal roller is employed, a pressing force at a level of 10 g/cm$^2$ or slightly higher may be employed. When the mechanical stimulation is to be exerted, it is preferred to exert the mechanical stimulation in such a state that water molecules or their modifications (such as hydroxyl groups OH) are adsorbed, bonded or contacted to the surface on which the mechanical stimulation is to be exerted. For this purpose, it is effective to adopt a method of spraying or dropping water or a liquid containing water to the hydrophilicity-imparted oxide surface or humidifying the atmosphere. With respect to a medium to be employed to exert the mechanical stimulation, there is no particular restriction, and any medium may be effectively used so long as it is capable of exerting a proper pressing force or frictional force to the oxide surface, irrespective of the means such as contact pressing of solid, liquid jetting or gas jetting.

In the printing technique, it has been common that as shown in the above-mentioned JP-A-11-58831, after transferring an image pattern to an image receiving member by passing the member between a pressing roller and a buckup roller having a polarity-reversible layer formed on its surface, hydrophobic treatment of the polarity-reversible layer is carried out by a heating mechanism or the like to carry out hydrophobic treatment of the polarity-reversible layer used for the transfer.

Whereas, in the present invention, by employing an oxide solid as the polarity-reversible layer, hydrophobic treatment of the surface of the polarity-reversible layer will be completed immediately after the image-receiving member is discharged, as the hydrophilic region of the polarity-reversible layer has received a mechanical stimulation from each roller when the image-receiving layer is passed between the pressing roller and the buckup roller having the polarity-reversible layer formed on its surface. Accordingly, it is unnecessary to install a heating mechanism or the like for the hydrophobic treatment, whereby the apparatus can be remarkably simplified, and the cost can be reduced.

It is considered that the moisture adsorbed, contacted or bonded to the hydrophilic oxide solid surface and the mechanical stimulation exerted to the solid surface will serve to remove structurally unstable hydroxyl groups on the hydrophilic oxide solid surface and to re-bond oxygen atoms to such a region, whereby the oxide solid surface will exhibit the inherent hydrophobic property.

Now, the present invention will be described in further detail with reference to Examples. However, it should be understood that the present invention is by no means restricted to such specific Examples.

EXAMPLE 1

A sample prepared by epitaxially growing a thin film of single crystal titanium oxide having an anatase type crystal structure on a strontium titanite (001) single crystal substrate, was used as an oxide solid surface. Hydrophilic treatment was carried out by irradiating ultraviolet rays from a 200 W xenon lamp on the sample surface via an optical fiber for 20 minutes. FIG. 1 is a photograph showing deposition of water droplets on the sample surface treated by this hydrophilic treatment, as photographed from the direction of a side surface of the substrate by a contact angle measuring apparatus (TANTEC contact angle meter).

It is shown that both of the two portions at which droplets A and B were dropped, were hydrophilic with contact angles of not more than 5°. Using a glass rod which was slightly etched with an alkali solution and then thoroughly washed with pure water, a mechanical stimulation was exerted a few times with a frictional force at a level of 100 g/cm$^2$ to a part of the surface of the anatase type titanium oxide single crystal with which the left hand side water droplet B was in contact, and then the water was removed.

Figure 2:
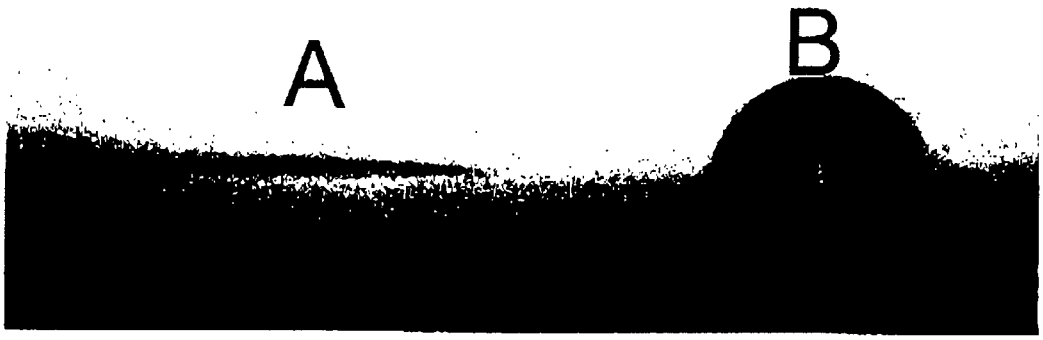
FIG. 2 is a photograph showing deposition of water droplets on the surface of titanium oxide crystal having a crystal structure of anatase type having hydrophobic treatment applied to a local region in Example 1, as photographed from the direction of a side surface of the substrate by a contact angle measuring apparatus.

After the above hydrophobic treatment of the local region, the contact angles of water droplets A and B were measured again, and the results are shown in FIG. 2 (which is a photograph similar to FIG. 1). It is evident from FIG. 2 that the left hand side water droplet A maintains the hydrophilic property with a contact angle of not more than 5°, whereas the region of the right hand side water droplet B having the hydrophobic treatment applied to the local region (i.e. the region which was hydrophilic in FIG. 1) was changed to be hydrophobic, and the contact angle increased to a level of 80°. It was possible to control the operation so as to change the hydrophilic surface to a hydrophobic surface in only about 30 seconds. Further, as is evident from FIG. 2, it was possible to optionally prepare hydrophilic/hydrophobic regions locally by the presence or absence of exertion of the pressure, and rapid switching from the hydrophilicity to the hydrophobicity was realized.

EXAMPLE 2

Figure 3:
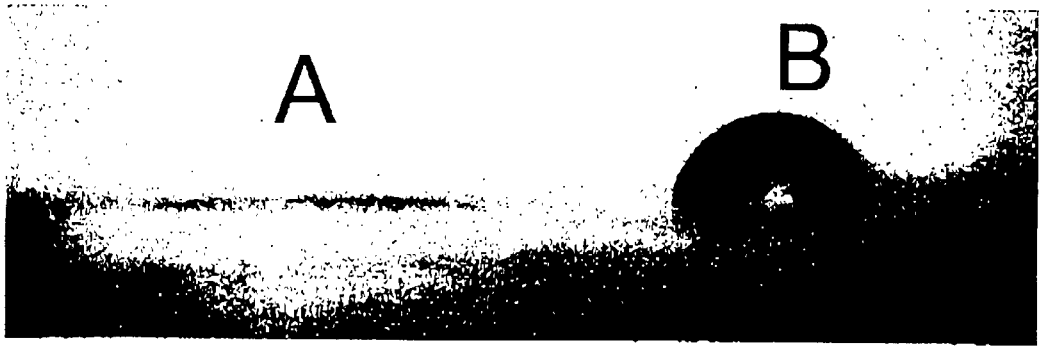
FIG. 3 is a photograph showing deposition of water droplets on the surface of titanium oxide crystal having a crystal structure of rutile type having hydrophobic treatment applied to a local region in Example 1, as photographed from the direction of a side surface of the substrate by a contact angle measuring apparatus.

A pressure was exerted to a local region on the surface in the same manner as in Example 1 except that a single crystal sample having a rutile type crystal structure was used as the oxide solid surface. As shown in FIG. 3, rapid switching from the hydrophilicity to the hydrophobicity of the local region was realized in the same manner as in Example 1.

According to the method of the present invention, switching from the hydrophilicity to the hydrophobicity of an oxide solid surface which was prepared by treating the surface of the hydrophobic oxide to be hydrophilic, can be facilitated by at least 10,000 times faster than before (a few weeks to less than 1 minute). In addition to this rapid switching, control of the hydrophilicity/hydrophobicity of local regions, which used to be impossible, can be realized, and it is possible to form patterns having the hydrophilicity and the hydrophobicity controlled at optional regions on the surfaces of various articles.

What is claimed is:

1. A method for rapidly restoring hydrophobicity to a hydrophilicity-imparted oxide solid surface, which comprises exerting a mechanical stimulation of a pressing or frictional force to a desired region of said hydrophilicity-imparted oxide solid surface, in a sufficient amount to change said region to be hydrophobic.

2. The method according to claim 1, wherein the mechanical stimulation is exerted while moisture is supplemented to the desired region of the oxide solid surface.

3. The method according to claim 1, wherein the oxide is an oxide containing a titanium atom.

4. The method according to claim 3, wherein the oxide containing a titanium atom is titanium dioxide having an anatase or rutile crystal structure, or a mixture of anatase and rutile crystal structures.

* * * * *